US008091628B2

(12) United States Patent
Peer et al.

(10) Patent No.: US 8,091,628 B2
(45) Date of Patent: Jan. 10, 2012

(54) APPARATUS AND METHOD FOR PROVIDING FLUID AND PROJECTILES TO DOWNHOLE TUBULARS

(75) Inventors: Richard David Peer, Katy, TX (US); Robert James Costo, Jr., The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 242 days.

(21) Appl. No.: 11/755,404

(22) Filed: May 30, 2007

(65) Prior Publication Data

US 2008/0296012 A1 Dec. 4, 2008

(51) Int. Cl.
*E21B 23/08* (2006.01)
*E21B 33/05* (2006.01)

(52) U.S. Cl. ..... 166/70; 166/285; 166/75.15; 166/177.4

(58) Field of Classification Search ..... 166/285, 166/70, 82.1, 75.15, 177.4
See application file for complete search history.

(56) References Cited

U.S. PATENT DOCUMENTS

| | | | | |
|---|---|---|---|---|
| 2,713,909 | A | 7/1955 | Baker | |
| 6,182,752 | B1 * | 2/2001 | Smith et al. | 166/70 |
| 6,302,199 | B1 | 10/2001 | Hawkins et al. | |
| 6,715,541 | B2 * | 4/2004 | Pedersen et al. | 166/75.15 |
| 7,055,611 | B2 * | 6/2006 | Pedersen et al. | 166/75.15 |
| 7,413,008 | B2 * | 8/2008 | Basso | 166/90.1 |
| 2003/0132002 | A1 | 7/2003 | Giebeler et al. | |
| 2003/0155114 | A1 | 8/2003 | Pedersen et al. | |
| 2006/0027122 | A1 * | 2/2006 | Arce et al. | 102/313 |
| 2006/0027360 | A1 * | 2/2006 | Basso | 166/177.4 |
| 2008/0223587 | A1 * | 9/2008 | Cherewyk | 166/386 |

FOREIGN PATENT DOCUMENTS

| | | | |
|---|---|---|---|
| GB | 2340861 | A | 3/2000 |
| RU | 2030552 | C1 | 3/1995 |
| WO | 2006/014939 | A2 | 2/2006 |
| WO | 2006014939 | A2 | 2/2006 |

OTHER PUBLICATIONS

UK Search Report dated Jul. 4, 2008 for UK Application No. GB0809477.3.
United Kingdom Search Report for GB Application No. 0809477.3, Dec. 7, 2009.
Examination Report issued in corresponding British Patent Application No. GB0809477.3; Dated May 7, 2010 (1 page).
Combined Search and Examination Report issued in related British patent application No. GB1011362.9; Dated Aug. 12, 2010 (6 pages)
.

* cited by examiner

*Primary Examiner* — Shane Bomar
*Assistant Examiner* — Elizabeth Gottlieb
(74) *Attorney, Agent, or Firm* — Rodney Warfford; Tim Curington; Lisa Margonis

(57) ABSTRACT

Apparatus and methods for providing fluid and projectiles to downhole tubulars includes a manifold. The manifold may include a housing, a cartridge disposed within the housing, and an actuator. The cartridge includes multiple throughbores for selectively allowing a fluid flow to pass through, and storing a projectile. The actuator is adapted to move the multiple throughbores of the cartridge out of and into the fluid flow to release the stored projectile into the fluid flow. The manifold may include multiple projectiles that are stored laterally relative to each other for radial translation and release into the fluid flow.

28 Claims, 10 Drawing Sheets

APPARATUS AND METHOD FOR PROVIDING FLUID AND PROJECTILES TO DOWNHOLE TUBULARS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

1. Field of Art

The present invention relates generally to apparatus and methods for cementing downhole tubulars into a well bore. More particularly, the present invention relates to a cementing manifold and method of use.

2. Description of Related Art

A well-known method of drilling hydrocarbon wells involves disposing a drill bit at the end of a drill string and rotating the drill string from the surface utilizing either a top drive unit or a rotary table set in the drilling rig floor. As the well is formed, it is desirable to line the well bore. Thus, as drilling continues, progressively smaller diameter tubulars comprising casing and/or liner strings may be installed end-to-end to line the drilled borehole. As the well is drilled deeper, each string is run through and secured to the lower end of the previous string to line the borehole wall. The string is then cemented into place by flowing cement down the flowbore of the string and up the annulus formed by the string and the borehole wall.

To conduct the cementing operation, typically a cementing manifold is disposed between the top drive unit or rotary table and the drill string. Due to its position in the drilling assembly, the cementing manifold must suspend the weight of the drill pipe, contain pressure, transmit torque, and allow unimpeded rotation of the drill string. When utilizing a top drive unit, a separate inlet is typically provided to connect the cement lines to the cementing manifold. This allows cement to be discharged through the cementing manifold into the drill string without flowing through the top drive unit.

In operation, the cementing manifold allows fluids, such as drilling mud or cement, to flow therethrough while simultaneously enclosing and protecting from that flow, a series of projectiles, e.g., darts and spheres, that are released on demand and in sequence to perform various operations downhole. Thus, as fluid flows through the cementing manifold, the darts and/or spheres are isolated from the fluid flow until they are ready for release.

Conventional cementing manifolds are available in a variety of configurations, with the most common configuration including a single sphere/single dart manifold. Using such a device, the sphere is dropped at a predetermined time during drilling to perform a particular function. For example, a sphere may be dropped to form a temporary seal or closure of the flowbore of the drill string or to actuate a downhole tool, such as a liner hanger, in advance of the cementing operation. Once the cement has been pumped downhole, the dart is dropped to perform another operation, such as wiping cement from the inner wall of a string of downhole tubular members.

Another common cementing manifold employs a single sphere/double dart configuration. The sphere may be released to actuate a downhole tool, for example, followed by the first dart being launched immediately ahead of the cement, and the second dart being launched immediately following the cement. Thus, the dual darts cap the "ends" of the cement and prevent the cement from mixing with drilling fluid as the cement is pumped downhole through the drill string. Each dart typically also performs another operation upon reaching the bottom of the drill string, such as latching into a larger dart to wipe cement from the string of downhole tubular members.

Whether the cementing manifold includes a single sphere/single dart or single sphere/double dart configuration, there are operational characteristics common to both. Loading and certification of the cementing manifold is not performed at the drill site. Instead, the sphere and dart(s) are typically loaded into the cementing manifold, with the customer present to verify the loading procedure, prior to transporting the cementing manifold to the drill site. Also, the majority of cementing jobs require a single sphere and at most two darts. Thus, a cementing manifold with a single sphere/single dart or single sphere/double dart configuration is sufficient for most cementing jobs.

Usually, two loaded cementing manifolds, including one for backup purposes, are then transported to the drilling rig. Prior to conducting a cementing job, rotation of the drill string is interrupted so that a loaded cementing manifold may be installed between the cementing swivel and drill string. In some configurations, the cementing manifold weighs several thousand pounds and may be 13 feet in length. Thus, given the weight and size of the cementing manifold, lifting it into position, which may be 20-30 feet above the rig floor, raises concerns for the safety of rig personnel. Therefore, it is desirable to reduce the size and weight of the cementing manifold so that installation of the cementing manifold may be both safer and easier.

Once the cementing manifold is installed, rotation of the drill string may resume, at least until the cementing operation begins. As previously stated, a sphere and dart(s) are released to perform various tasks at different stages of a cementing operation. During most cementing operations, actuation of valves to release the sphere and darts is performed manually by rig personnel. Rotation of the drilling string is again interrupted to allow rig personnel to traverse the thirty or so feet above the rig floor to the cementing manifold and manually actuate valves on the cementing manifold to release the sphere and darts. This too raises safety concerns. For this reason, some cementing manifolds may now be actuated to release the sphere and darts via remote control from the rig floor. Remote control actuation also allows rotation of the drill string to continue uninterrupted because rig personnel remain on the rig floor, a safe distance from the rotating equipment.

Verification that the sphere or dart has been released from the cementing manifold is performed by visual inspection. In the case of manual actuation, as the sphere or dart exits the cementing manifold, a flag on the cementing manifold is triggered. While this flag is designed to be visible from the rig floor, resetting the flag requires rig personnel to ascend the rig to manually reset the flag, there again raising safety concerns. In the case of remote control actuation, instead of a triggered flag, rig personnel view an indicating device that changes orientation on the cementing manifold when a sphere or dart has been released. However, the indicator is often shrouded within a plate assembly, requiring the rotating speed of the drill string be reduced so that rig personnel can clearly see the indicator orientation from the rig floor.

Thus, at the minimum, releasing a sphere or dart and verifying that release requires slowing the rotation of the drill string. Further, such release and verification frequently requires rig personnel to ascend the rig to the cementing manifold, raising concerns for the safety of rig personnel. Therefore, it is desirable to remotely actuate and remotely verify the release of spheres and darts from the cementing manifold, including resetting any involved devices prior to subsequent releases, without either the need to reduce the rotation speed of the drill string or for rig personnel to position themselves in proximity of the cementing manifold.

Once the cementing operation is complete, the cementing manifold may be empty. Typically, the cementing manifold is not reloaded and recertified on the drilling rig. Rather the empty manifold is removed from the drill string and stored on the drilling rig until it can be transported back to the laboratory for reloading and recertification. Given its size, storing the cementing manifold on the drilling rig may be less than convenient. At a length of 13 feet, the cementing manifold may not fit in standard racks, requiring it to be stored elsewhere on the drilling rig and thereby consuming valuable rig space. Therefore, it is also desirable to reduce the size of the cementing manifold such that it may be easily stored in standard sized racks.

SUMMARY OF DISCLOSED EMBODIMENTS

Apparatus and methods for cementing tubulars in a borehole are disclosed. In some embodiments, the downhole apparatus includes a housing, a cartridge disposed within the housing, and an actuator. The housing includes a fluid entry port and a fluid exit port. The cartridge includes a first chamber and is moveable between a first and a second position. In the first position, the first chamber is out of fluid communication with the entry port and the exit port. In the second position, the first chamber is in fluid communication with the entry port and the exit port. The actuator is adapted to move the cartridge between the first and second positions.

Some method embodiments for cementing tubulars in a borehole include providing a cement manifold having a through-passage in fluid communication with a tubing string which includes the tubulars, providing a cartridge disposed in the cement manifold, storing a projectile in the cartridge and isolated from the through-passage, conveying cement through the passageway, moving the cartridge in the cement manifold to bring the projectile into the through-passage, and expelling the projectile from the through-passage into the tubing string.

Some method embodiments for field-loading of a cement manifold include providing the cement manifold, a cartridge, and a projectile at a well site, inserting the projectile into the cartridge at the well site, and loading the cartridge into the cement manifold at the well site.

In some embodiments, the apparatus for installing tubulars in a borehole includes a fluid supply, a tubular member, and a manifold coupled to the fluid supply and the tubular member. The manifold includes a fluid passageway therethrough and a projectile stored therein. The apparatus further includes an actuator configured to move the projectile into the fluid passageway.

Thus, the embodiments described herein include a combination of features and characteristics that are intended to advance the state of the art involving cementing methods and apparatus. The various characteristics described above, as well as other features, will be readily apparent to those skilled in the art upon reading the following detailed description of the preferred embodiments and by referring to the accompanying drawings.

BRIEF DESCRIPTION OF THE DRAWINGS

For a more detailed description of the preferred embodiments, reference will now be made to the accompanying drawings, wherein.

DETAILED DESCRIPTION OF THE PREFERRED EMBODIMENTS

Figure 1:
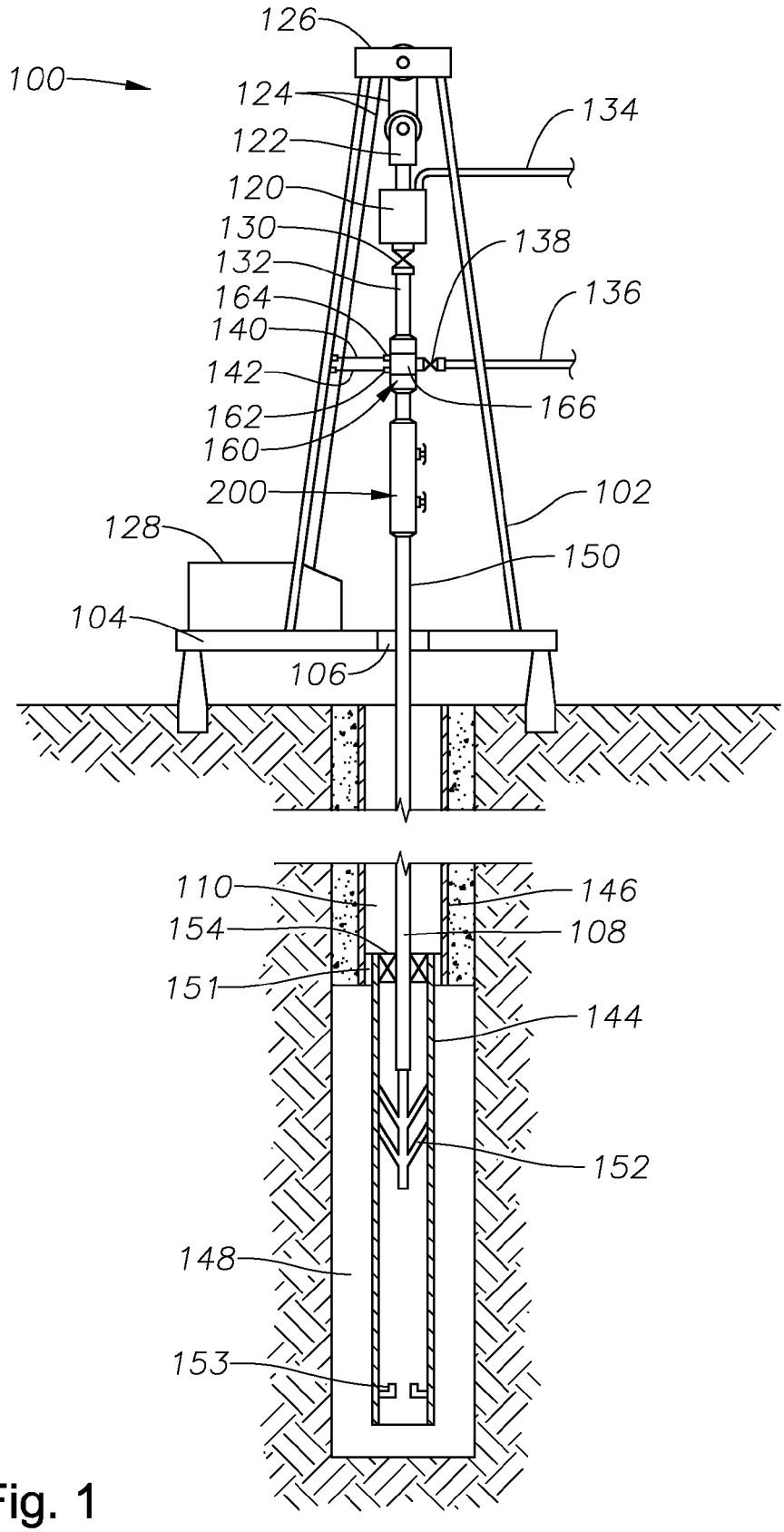
FIG. 1 schematically depicts an exemplary drilling system in which the various embodiments of a cementing manifold in accordance with the present invention may be used.

Certain terms are used throughout the following description and claims to refer to particular features or, components. As one skilled in the art will appreciate, different persons may refer to the same feature or component by different names. This document does not intend to distinguish between components or features that differ in name but not function. Further, the drawing figures are not necessarily to scale. Certain features and components herein may be shown exaggerated in scale or in somewhat schematic form, and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices and connections.

FIG. 1 schematically depicts an exemplary drilling system, one of many in which cementing manifolds and methods disclosed herein may be employed. The drilling system 100 includes a derrick 102 with a rig floor 104 at its lower end having an opening 106 through which drill string 108 extends downwardly into a well bore 110. The drill string 108 is driven rotatably by a top drive drilling unit 120 that is suspended from the derrick 102 by a traveling block 122. The traveling block 122 is supported and moveable upwardly and downwardly by a cabling 124 connected at its upper end to a crown block 126 and actuated by conventional powered draw works 128. Corrected below the top drive unit 120 is a kelly valve 130, a pup joint 132, a cementing swivel 160, and a cementing manifold, such as the canister fed cementing manifold 200, described more fully below. A flag sub 150, which provides a visual indication when a dart or sphere passes therethrough, is connected below the cementing manifold 200 and above the drill string 108. A drilling fluid line 134 routes drilling fluid to the top drive unit 120, and a cement line 136 routes cement through a valve 138 to the swivel 160. Tie-off connections 162, 164 secure the cementing swivel 160 to the derrick 102.

FIG. 1 depicts one example of a drilling environment in which the cementing manifolds and methods disclosed herein may be utilized. One of ordinary skill in the art will readily appreciate, however, that the embodiments disclosed herein are not limited to use with a particular type of drilling system. Rather, these embodiments may be utilized in other drilling environments such as, for example, to cement casing into an offshore well bore.

Figure 2:
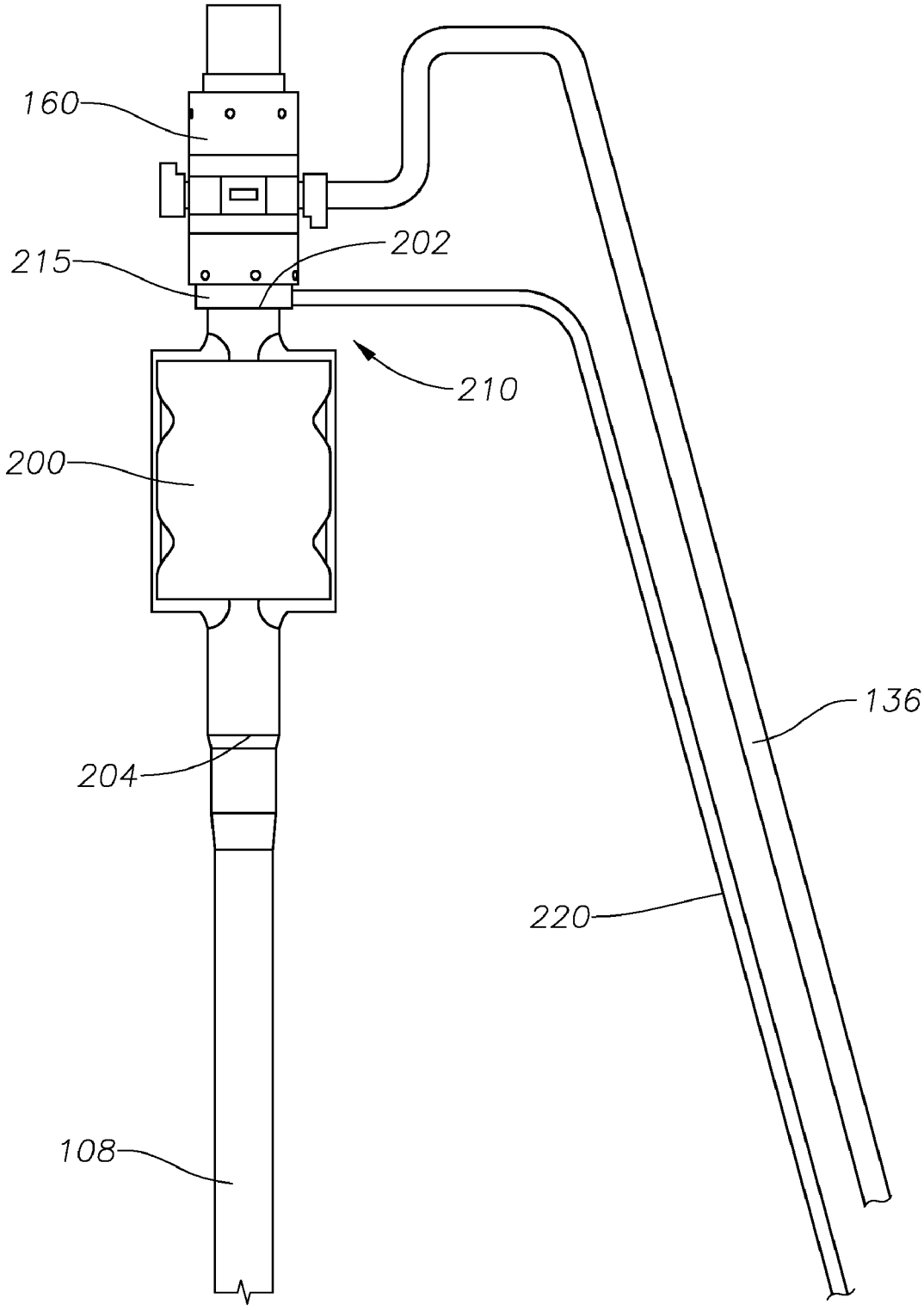
FIG. 2 schematically depicts a representative cementing manifold connected above to a cementing swivel and below to a drill string.

FIG. 2 schematically depicts a representative cementing manifold connected above to a cementing swivel and below to a drill string. As described in reference to and shown in FIG. 1, the cementing swivel 160 and the cementing manifold 200 are coupled to a drill string 108. Cement is provided to the cementing swivel 160 through cement line 136. The cement passes through the cementing swivel 160 and into the cementing manifold 200 through a fluid entry port 202. The cement continues through the cementing manifold 200 via a through-passage, such as a flowbore, and finally exits the cementing manifold through a fluid exit port 204. As the cement flows through the cementing manifold 200, projectiles, such as a dart and/or a sphere, may be released into the cement flow at desired times.

To release such projectiles, the cementing manifold 200 further includes a dart cartridge (not shown), a ball container (not shown), and an actuation system 210. The cartridge may store one or more darts for use in a cementing operation. Similarly, the container may store a sphere also for use in the cementing operation.

The actuation system 210 is configured to actuate the cartridge and the container to release the one or more darts and sphere, respectively, at desired times during the cementing operation. The actuation system 210 may use electrical, hydraulic, pneumatic, or other suitable means known in the industry to actuate the cartridge and the compartment. In the embodiments exemplified by FIG. 2, the actuation system 210 uses pressurized air to actuate the cartridge aid the container to release the dart(s) and sphere, respectively. In some embodiments, the operating range for the pressurized air may be 90 psi to 150 psi. To deliver pressurized air to the dart cartridge and the ball container, the actuation system 210 further includes air swivel 215 and air flow line 220.

FIGS. 3 through 9 are cross-sectional views of the cementing manifold 200, depicted in FIG. 2, before and after the dart cartridge and/or ball container have been actuated. In all of these figures, the cementing manifold 200 is shown coupled to the cementing swivel 160. Cement is provided to the cementing swivel 160 through cement line 136. Similarly, pressurized air is provided through the air flow line 220 to the air swivel 215 for actuating the dart cartridge and/or ball container.

Figure 3:
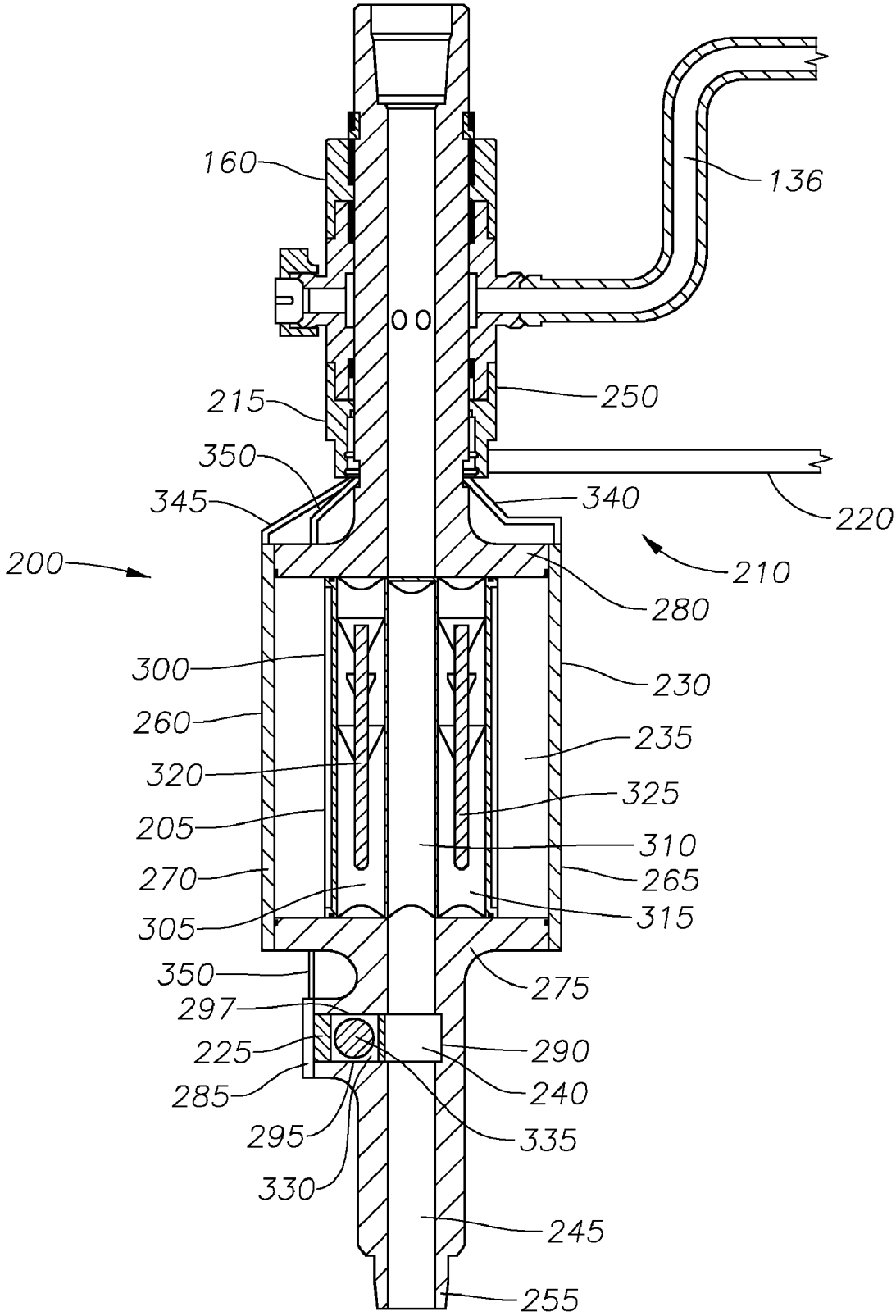
FIG. 3 is a cross-sectional view of the cementing manifold shown in FIG. 2.

Referring to FIG. 3, the cementing manifold 200 further includes an enclosure 230. The enclosure 230 further includes an upper end 250, a lower end 255, a body 260, a chamber 235, a compartment 240, and a flowbore 245 therethrough. The body 260 further includes two sides 265, 270, a base 275, and a top 280, all of which enclosure the chamber 235. Compartment 240 is disposed within the enclosure 230 near the lower end 255 of the enclosure 230. Compartment 240 bounded by enclosure walls 285, 290, 295, 297. The upper end 250 of the enclosure 230 may be connected to another tool, such as the cementing swivel 160, via a threaded connection or other suitable type of connection. Similarly, the lower end 255 of the enclosure 230 may be connected to another tool, such as the flag sub 150, or directly to the drill string 108 via a threaded connection or other suitable type of connection.

A cartridge 205 is disposed within the chamber 235 of the enclosure 230 and is free to translate along the base 275 of the enclosure body 260. The cartridge 205 further includes a body 300 having three longitudinal throughbores 305, 310, 315, each of which permits cement flow therethrough when aligned with the flowbore 245 of the enclosure 230 in FIG. 3, the center throughbore 310 of the cartridge 205 is aligned with the flowbore 245 of the enclosure 230. Moreover, the outer throughbores 305, 315 of the cartridge 205 are each designed to store a single dart. Thus, a loaded cartridge 205 stores a single dart in either or both of the outer throughbores 305, 315. In this figure, a first dart 320 is stored in the throughbore 305, and a second dart 325 is stored in the throughbore 315. The center throughbore 310 is not designed to store a dart. Rather, the throughbore 310 permits cement flow through the cementing manifold 200, including the cartridge 205, without exposing dart(s) stored in the outer throughbores 305, 315 to cement flow.

A container 225 is disposed within the compartment 240 and is flee to translate along enclosure wall 295. The container 225 is designed to hold a single ball or sphere. In this figure, a ball 335 is stored in container 225. The container 225 further includes a throughbore 330 which permits cement flow therethrough when aligned with the flowbore 245 of the enclosure 230. However, when throughbore 330 and flowbore 245 are not aligned, the container 225 isolates the ball 335 from cement flowing through the flowbore 245. Such is the configuration depicted in FIG. 3.

As described in reference to FIG. 2, the actuation system 210 includes the air swivel 215 and the air flow line 220, which provide pressurized air to the cementing manifold 200 for actuating the dart cartridge 205 and/or ball container 225. To distribute the pressurized air to the chamber 235 and the compartment 240, the actuation system 210 further includes the air distribution lines 340, 345, 350, as depicted in FIG. 3. The distribution lines 340, 345 are routed from the air swivel 215 through the enclosure body 260 along the sides 265, 270, respectively. The distribution line 340 provides a pathway for pressurized air to enter chamber 235 through side 265, while distribution line 345 provides a pathway for pressurized air to enter chamber 235 through side 270. The distribution line 350 is routed from the air swivel 215 through the enclosure body 260 along side 270, and through enclosure wall 285, which bounds compartment 240. The distribution line 350 provides a pathway for pressurized air to enter compartment 240 through enclosure wall 285.

Figure 4:
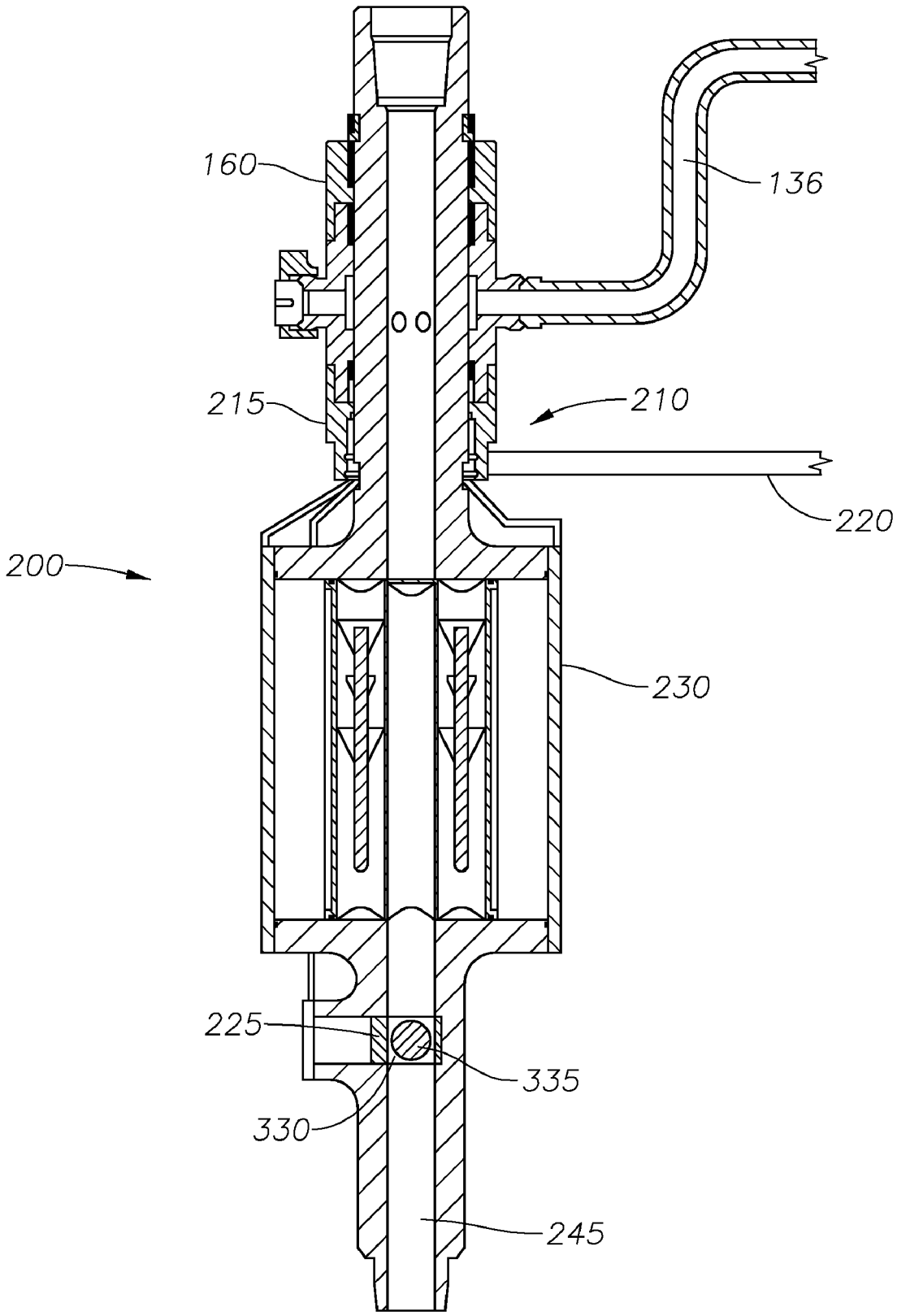
FIG. 4 is a cross-sectional view of the cementing manifold of FIG. 3 after the ball container is actuated.
Figure 5:
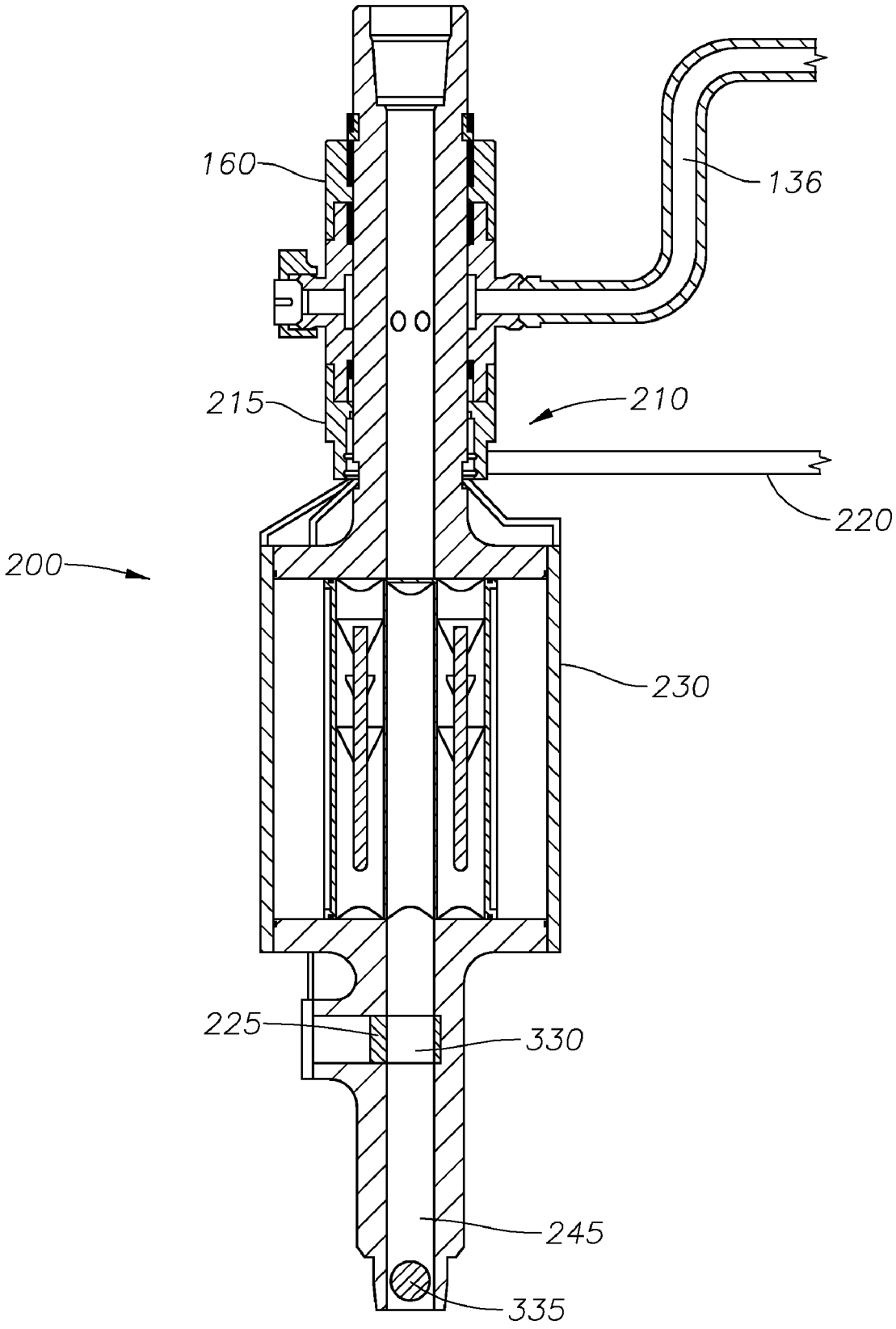
FIG. 5 is a cross-sectional view of the cementing manifold of FIG. 3 after the sphere is released.

FIG. 4 depicts the container 225 after actuation. As seen in this figure, the throughbore 330 is aligned with the flowbore 245, and the ball 335 sits ready for delivery into the drill string 108. When cement flows through the cementing manifold 200 via the flowbore 245, the ball 335 is carried from the cementing manifold 200 by the cement flow. FIG. 5 depicts the ball 335 after the cement flow has carried the ball 335 from the container 225 but prior to the ball 335 exiting the cementing manifold 200.

Figure 6:
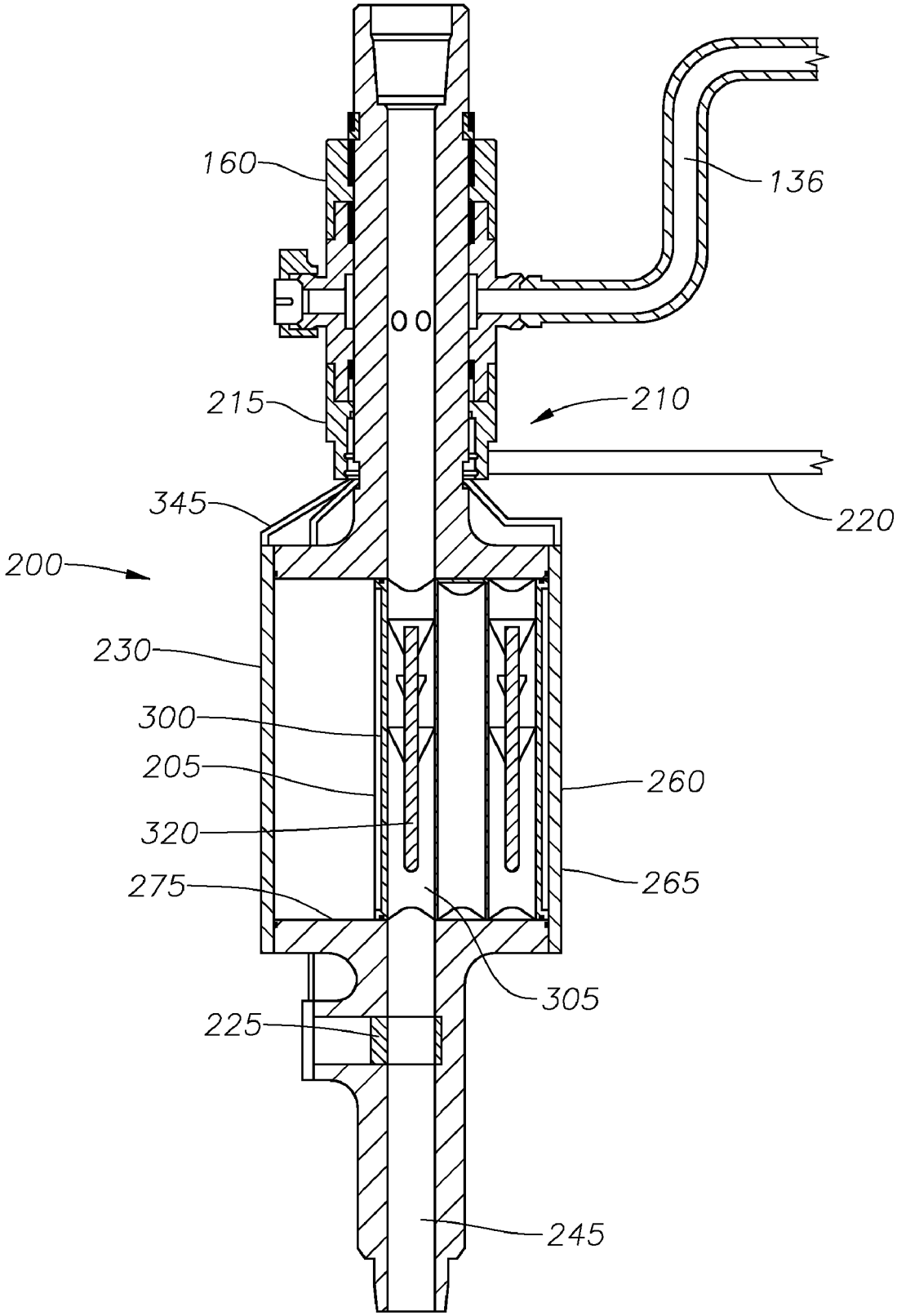
FIG. 6 is a cross-sectional view of the cementing manifold of FIG. 3 after the dart cartridge is actuated to release a first dart.
Figure 7:
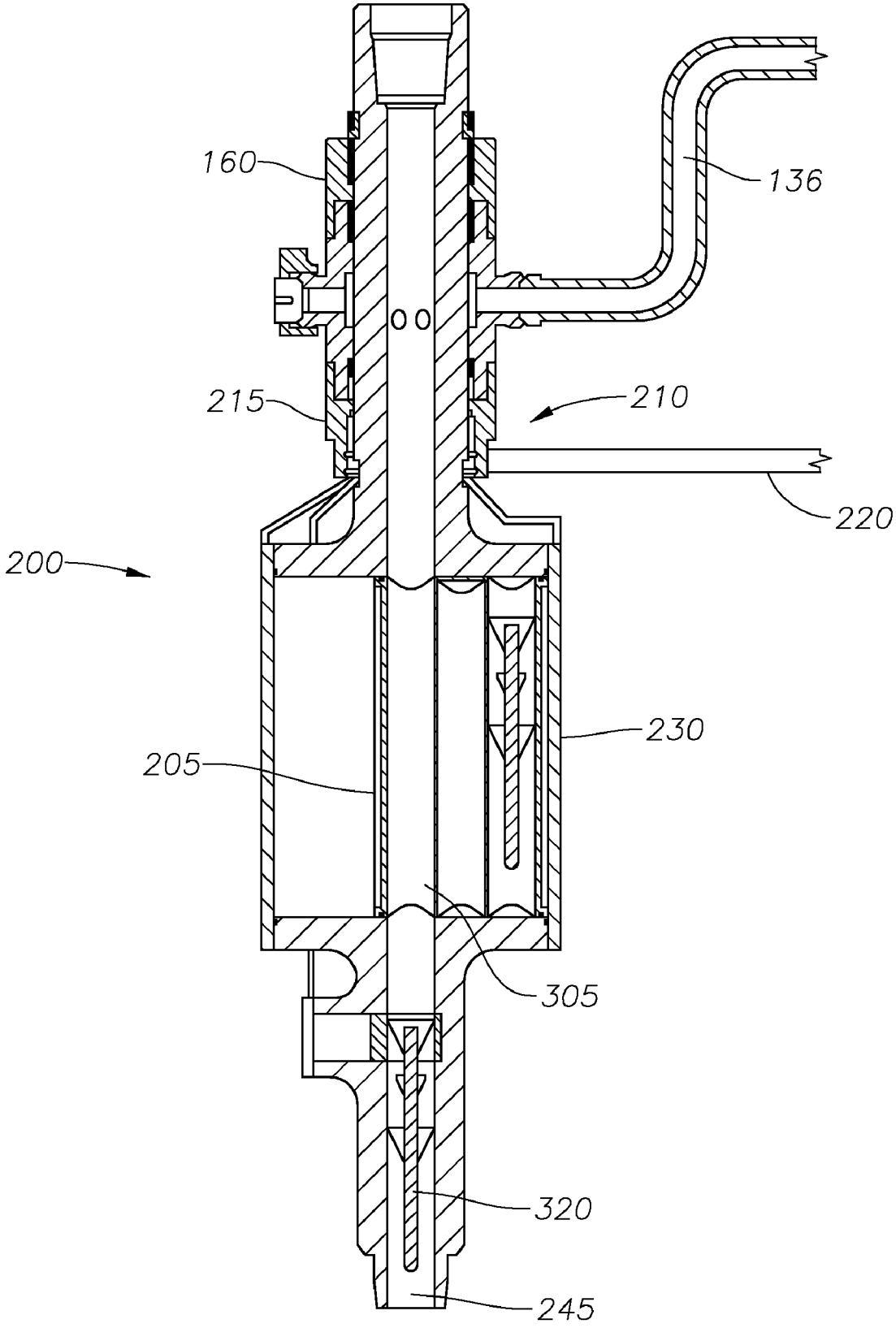
FIG. 7 is a cross-sectional view of the cementing manifold of FIG. 3 after the first dart is released.

FIG. 6 depicts the cartridge 205 after actuation to release dart 320. As seen in this figure, the throughbore 305 is aligned with the flowbore 245, and the dart 320 sits ready for delivery into the drill string 108. When cement flows through the cementing manifold 200 via the flowbore 245, the dart 320 is carried from the cementing manifold 200 by the cement flow. FIG. 7 depicts the daft 320 after the cement flow has carried the dart 320 from the cartridge 205 but prior to the dart 320 exiting the cementing manifold 200.

Figure 8:
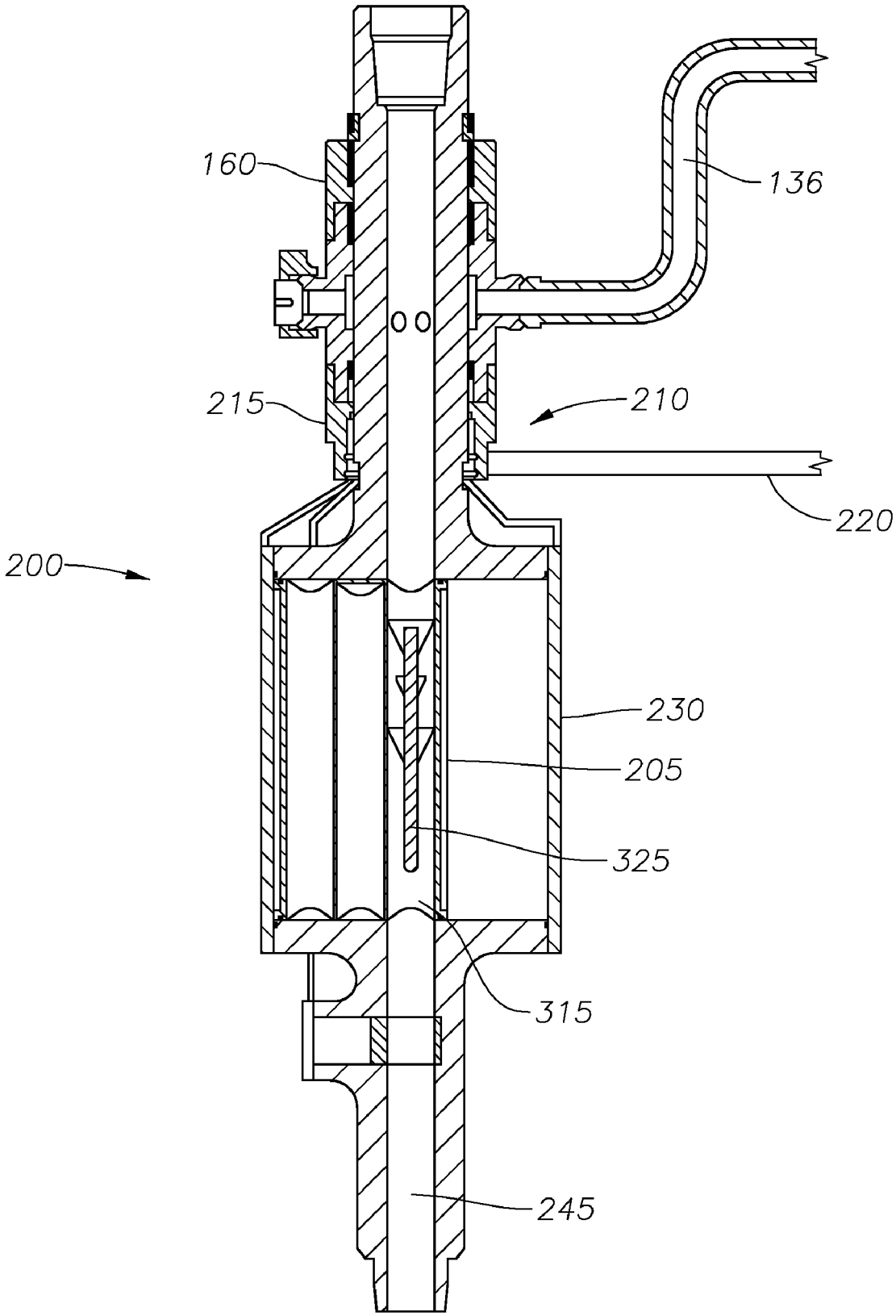
FIG. 8 is a cross-sectional view of the cementing manifold of FIG. 3 after the dart cartridge is actuated to release a second dart.
Figure 9:
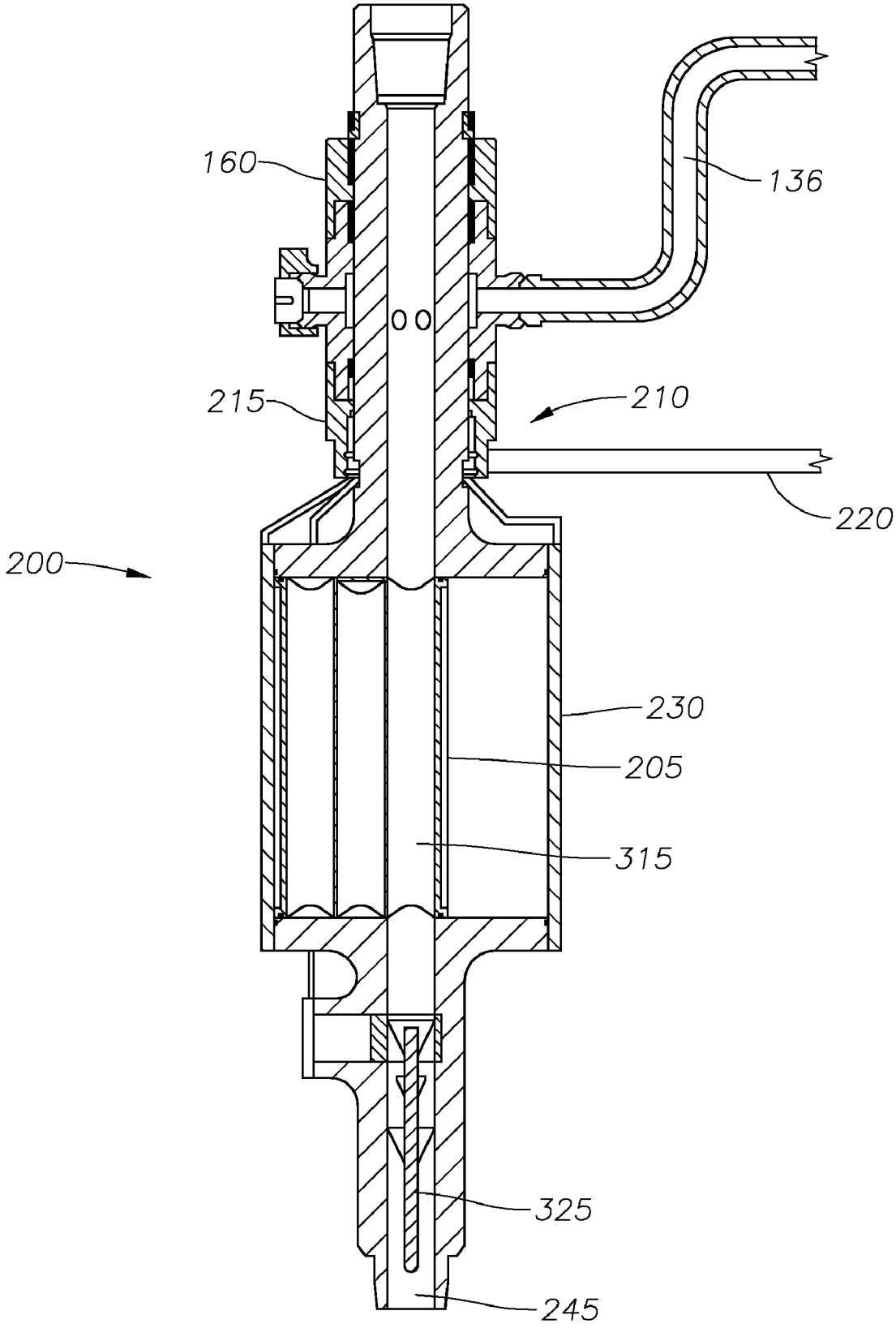
FIG. 9 is a cross-sectional view of the cementing manifold of FIG. 3 after the second dart is released.

FIG. 8 depicts the cartridge 205 after actuation to release dart 325. As seen in this figure, the throughbore 315 is aligned with the flowbore 245, and the dart 325 sits ready for delivery into the drill string 108. When cement flows through the cementing manifold 200 via flowbore 245, the dart 325 is carried from the cementing manifold 200 by the cement flow. FIG. 9 depicts the dart 325 after the cement flow has carried dart 325 from cartridge 205 but prior to the dart 325 exiting the cementing manifold 200.

Prior to a cementing operation, one or two darts 320, 325 may be loaded into the cartridge 205, as shown in FIG. 3. Similarly, a ball or sphere 335 may be loaded into the container 225. The loaded cartridge 205 and/or loaded container 225 may then be inserted into the cementing manifold 200. The cementing manifold 200 may be located on the rig floor 104 awaiting installation below the cementing swivel 160 or already suspended below the cementing swivel 160. In either scenario, the cartridge 205 and/or container 225 is field-loaded, meaning a dart 320, 325 and/or sphere 335 is loaded into the cartridge 205 and/or container 225 at the well site and the cartridge 205 and/or container 225 is inserted into the cementing manifold 200 also at the well site. This loading procedure may be verified at the well site. By contrast, conventional manifolds are typically loaded in a location remote from the well site, e.g., in a laboratory or assembly shop, and verified there as well. Moreover, the loading procedure may be verified at the well site.

Once the cementing operation begins, referring again to FIG. 17 drilling fluid flows through line 134 down into the drill string 108 while the top drive unit 120 rotates the drill string 108. The housing 166 of cementing swivel 160 is tied-off to the derrick 102 via lines or bars 140, 142 such that the swivel housing 166 cannot rotate aid remains stationary while the mandrel of the swivel 160 rotates within housing 166 to enable the top drive unit 120 to rotate the drill string 108. To perform an operation such as, for example, actuating a downhole tool to suspend a tubular 144 from existing and previously cemented casing 146, a projectile, such as a sphere or ball, may be dropped from the cementing manifold 200.

Release of a ball 335 from cementing manifold 200 is remotely actuated via a signal transmitted from a location remote to the cementing manifold 200, including the rig floor 104. When the actuation system 210 receives a signal directing the system 210 to actuate the container 225 to release the ball 335, the actuation system 210 in response permits a burst of pressurized air to flow from the air flow line 220, through the air swivel 215 and the distribution line 350, and into compartment 240. Upon injection into compartment 240, the pressurized air actuates the container 225 by applying a pressure load to the container 225. The pressure load causes the container 225 to translate along the enclosure wall 295 until the container 225 contacts the enclosure wall 290. When the container 225 contacts the wall 290, the container 225 ceases to translate along the wall 295, leaving the throughbore 330, which contains the ball 335, aligned with the enclosure flowbore 245, as shown in FIG. 4. Thus, the actuation system 210, in response to a remote signal, actuates the container 225 to release the ball 335 without the need to position rig personnel in close vicinity of the cementing manifold 200 and without the need to slow or interrupt rotation of the drill string 108.

In the exemplary embodiments described herein, actuation system 210 actuates cartridge 205 and container 225 to move radially within enclosure 230 to position dart 320, 325 and sphere 335 in flowbore 245, where the radial direction is normal to the centerline of enclosure 230. In other embodiments, the actuation system 210 may actuate cartridge 205 and/or container 225 to move axially, or to move radially and axially, to position darts 320, 325 and sphere 335 in flowbore 245, where the axial direction is parallel to the centerline of enclosure 230.

Moreover, cartridge 205 and container 225 are axially displaced from one another within enclosure 230. For example, cartridge 205 is positioned above container 225, closer to the upper end 250 of enclosure 230. In other embodiments, container 225 may be positioned above cartridge 205, and in still other embodiments, cartridge 205 and container 225 may be axially aligned.

When ball container 225 is actuated, the actuation system 210 transmits a signal to a remote location indicating that the ball container 225 was actuated. Moreover, as the ball 335 exits the cementing manifold 200, the actuation system 210 transmits another signal to a remote location indicating that the sphere 335 has been delivered from the cementing manifold 200 into the drill string 108. Thus, actuation of the ball container 225 as well as the release of a sphere 335 from the cementing manifold 200 into the drill string 108 are remotely verified without the need to position rig personnel in the vicinity of the cementing manifold 200 and without the need to slow or interrupt rotation of the drill string 108.

After the ball 335 is released and the tubular 144 is suspended from the casing 146 via a rotatable liner hanger 151, 154, cement will be pumped down through the drill string 108 and through the tubular 144 to fill the annular area 148 in the uncased well bore 110 around the tubular 144. To initiate the cementing operation, the kelly valve 130 is closed, and the valve 138 to the cement line 136 is opened, thereby allowing cement to flow through the swivel 160 and down into the drill string 108. Thus, the swivel 160 enables cement flow to the drill string 108 while bypassing the top drive unit 120.

It is preferable to rotate the drill string 108 during cementing to ensure that cement is distributed evenly around the tubular 144 downhole. More specifically, because the cement is a thick slurry, it tends to follow the path of least resistance. Therefore, if the tubular, 144 is not centered in the well bore 110, the annular area 148 will not be symmetrical, and cement may not completely surround the tubular 144. Thus, it is preferable for the top drive unit 120 to continue rotating the drill string 108 through the swivel 160 while cement is introduced from the cement line 136.

As the cementing operation progresses, cement flows through the cementing swivel 160 and into the cementing manifold 200. When passing through the cementing manifold 200, the cement flows through only one of the throughbores 305, 310, 315 of the cartridge 205 at any given time, depending on which of the throughbores 305, 310, 315 is aligned with the flowbore 245 of the enclosure 230. In FIG. 3, the center throughbore 310 is aligned with the flowbore 245. Thus, in this configuration, cement flow through the cementing manifold 200 passes through the center throughbore 310 of the cartridge 205. Moreover, since the darts 320, 325 are stored in the throughbores 305, 315 and throughbores 305, 315 are out of communication with the cement flow, the cement passes through the cementing manifold 200 without the darts 320, 325 being exposed to the cement flow.

When the throughbore 305 is aligned with the flowbore 245, cement flow through the cementing manifold 200 passes through the aligned throughbore 305 and carries the dart 320 from the cementing manifold 200. Similarly, when the throughbore 315 is aligned with the flowbore 245, cement flow through the cementing manifold 200 passes through the aligned throughbore 315 and carries the dart 325 from the cementing manifold 200. To align either the throughbore 305 or the throughbore 315 with the flowbore 245 requires actuation of the cartridge 205 by the actuation system 210.

When the appropriate volume of cement has been pumped into the drill string 108, another projectile, for instance a dart, is typically dropped from the cementing manifold 200 to latch into a larger dart 152, shown in FIG. 1, to wipe cement from the tubular 144 and land in the landing collar 153 adjacent the bottom end of the tubular 144. Release of a dart 320, 325 from cementing manifold 200 is also remotely actuated via a signal transmitted from a location remote to the cementing manifold 200, including the rig floor 104.

When the actuation system 210 receives a signal directing the system 210 to actuate the cartridge 205 to release the dart 320, the actuation system 210 in response permits a burst of pressurized air to flow from the air flow line 220, through the air swivel 215 and the distribution line 345, and into chamber 235. Upon entering the chamber 235, the pressurized air actuates the cartridge 205 by applying a pressure load to the body 300 of the cartridge 205, causing the cartridge 205 to translate along the base 275 until the cartridge 205 contacts side 265 of the enclosure body 260. When the cartridge 205 contacts the side 265, the cartridge 205 ceases to translate along the base 275 and the throughbore 305, which contains the dart 320, is aligned with the enclosure flowbore 245, as seen in FIG. 6. Thus, the actuation system 210, in response to a remote signal, actuates the cartridge 205 to release the dart 320 without the need to position rig personnel in close vicinity of the cementing manifold 200 and without the need to slow or interrupt rotation of the drill string 108.

After dart cartridge 205 is actuated, the actuation system 210 transmits a signal to a remote location indicating that the dart cartridge 205 was actuated. Moreover, as the dart 320 exits the cementing manifold 200, the actuation system 210 transmits another signal to a remote location indicating that the dart 320 has been delivered from the cementing manifold 200 into the drill string 108. Thus, actuation of the dart cartridge 205 as well as the release of a dart 320 from the cementing manifold 200 into the drill string 108 are remotely verified without the need to position rig personnel in the vicinity of the cementing manifold 200 and without the need to slow or interrupt rotation of the drill string 108.

During some cementing operations, it may be necessary to release a second dart. Referring again to FIG. 7, when the actuation system 210 receives a signal directing the system 210 to actuate the cartridge 205 to release the second dart, specifically dart 325, the actuation system 210 in response permits a burst of pressurized air to flow from the air flow line 220, through the air swivel 215 and the distribution line 340, and into chamber 235. Upon entering the chamber 235, the pressurized air actuates the cartridge 205 by applying a pressure load to the cartridge 205, causing the cartridge 205 to translate along the base 275 until the cartridge 205 contacts the side 270 of the enclosure body 260. When the cartridge 205 contacts side 270, the cartridge 205 ceases to translate along base 275 and the throughbore 315, which contains the dart 325, is aligned with the enclosure flowbore 245, as shown in FIG. 8. Thus, the actuation system 210, in response to a remote signal, actuates the cartridge 205 to release the dart 325, again without the need to position rig personnel in close vicinity of the cementing manifold 200 and without the need to slow or interrupt rotation of the drill string 108.

After dart cartridge 205 is actuated, the actuation system 210 transmits a signal to a remote location indicating that the dart cartridge 205 was actuated. Moreover, as the dart 325 exits the cementing manifold 200, the actuation system 210 transmits another signal to a remote location indicating that the dart 325 has been delivered from the cementing manifold 200 into the drill string 108. Thus, actuation of the dart cartridge 205 as well as the release of a dart 325 from the cementing manifold 200 into the drill string 108 are remotely verified without the need to position rig personnel in the vicinity of the cementing manifold 200 and without the need to slow or interrupt rotation of the drill string 108.

When the dart cartridge 205 and/or the ball container 225 are empty, the cementing manifold 200 may be preferably reloaded in place, meaning as the cementing manifold 200 remains suspended below the cementing swivel 160. Alternatively, the cementing manifold 200 may be disengaged from below the cementing swivel 160 and returned to the rig floor 104 for reloading. In either scenario, the empty cartridge 205 and/or empty ball container 225 may be removed from the cementing manifold 200 and replaced with a loaded cartridge and/or ball container at the well site. If the cementing operation is complete and the cementing manifold 200 no longer needed, the cementing manifold 200 may be disengaged from below the cementing swivel 160 and stored in a standard rack located somewhere on the rig floor 104.

Figure 10:
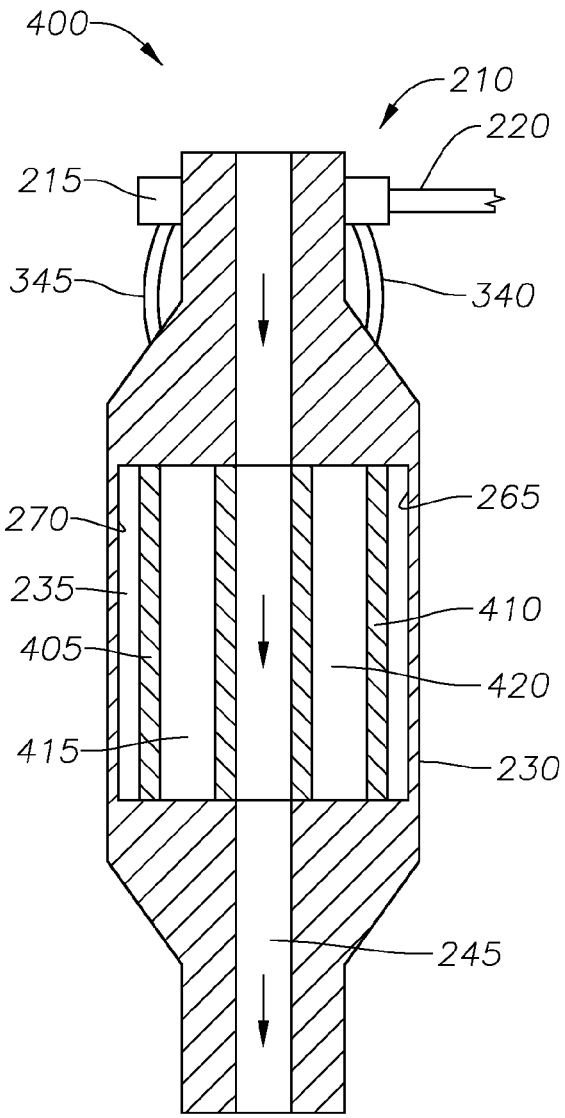
FIG. 10 schematically depicts another embodiment of a representative cementing manifold.

Referring next to FIG. 10, another embodiment of a cementing manifold is shown. A cementing manifold 400, exemplified by FIG. 10, is similar to cementing manifold 200, described with reference to FIGS. 2 through 9, both in structure and operation. While cementing manifold 400 depicted in FIG. 10 is not shown to include a ball container, in some embodiments the cementing manifold 400 may include a ball container similar to container 225 employed in cementing manifold 200 previously described. The primary difference between the cementing manifold 200 exemplified by FIGS. 2 through 9 and cementing manifold 400 exemplified by FIG. 10 relates to the dart cartridge.

In cementing manifold 200, depicted in FIGS. 2 through 9, the cartridge 205 includes a single body 300 having three longitudinal throughbores 305, 310, 315. By contrast, the cementing manifold 400 depicted in FIG. 10 includes two separate tubes 405, 410, in place of the single cartridge 205, within the chamber 235 of the enclosure 230. A dart may be stored within each tube 405, 410 for subsequent release during a cementing operation. The tube 405 further includes a throughbore 415 that permits cement flow therethrough when aligned with the flowbore 245 of the enclosure 230. Similarly, the tube 410 further includes a throughbore 420 that permits cement flow therethrough when aligned with the flowbore 245.

Referring still to FIG. 10, cementing manifold 400 employs an actuation system 210 as previously described. When the actuation system 210 receives a signal directing the system 210 to actuate the tube 405 to release a dart stored therein during a cementing operation, the actuation system 210 in response permits a burst of pressurized air to flow from the air flow line 220, through the air swivel 215 and the distribution line 345, and into chamber 235. Upon entering the chamber 235, the pressurized air actuates the tube 405 by applying a pressure load to the outer surface of the tube 405, causing the tube 405 to translate along the base 275 until the tube 405 contacts the tube 410. When the tube 405 contacts the tube 410, the tube 405 ceases to translate along the base 275 and the throughbore 415, which contains a dart, is aligned with the enclosure flowbore 245. Thus, the actuation system 210, in response to a remote signal, actuates the tube 405 to release a dart.

Alternatively, the actuation system 210 may receive a signal directing the system 210 to actuate the tube 410 to release a dart stored therein. In response, the actuation system 210 permits a burst of pressurized air to flow from the air flow line 220, through the air swivel 215 and the distribution line 340, and into chamber 235. Upon entering the chamber 235, the pressurized air actuates the tube 410 by applying a pressure load to the outer surface of the tube 410, causing the tube 410 to translate along the base 275 until the tube 410 contacts the tube 405. When the tube 410 contacts the tube 405, the tube 410 ceases to translate along the base 275 and the throughbore 420, which contains a dart, is aligned with the enclosure flowbore 245. Thus, the actuation system 210, in response to a remote signal, actuates the tube 410 to release a dart.

Figure 11:
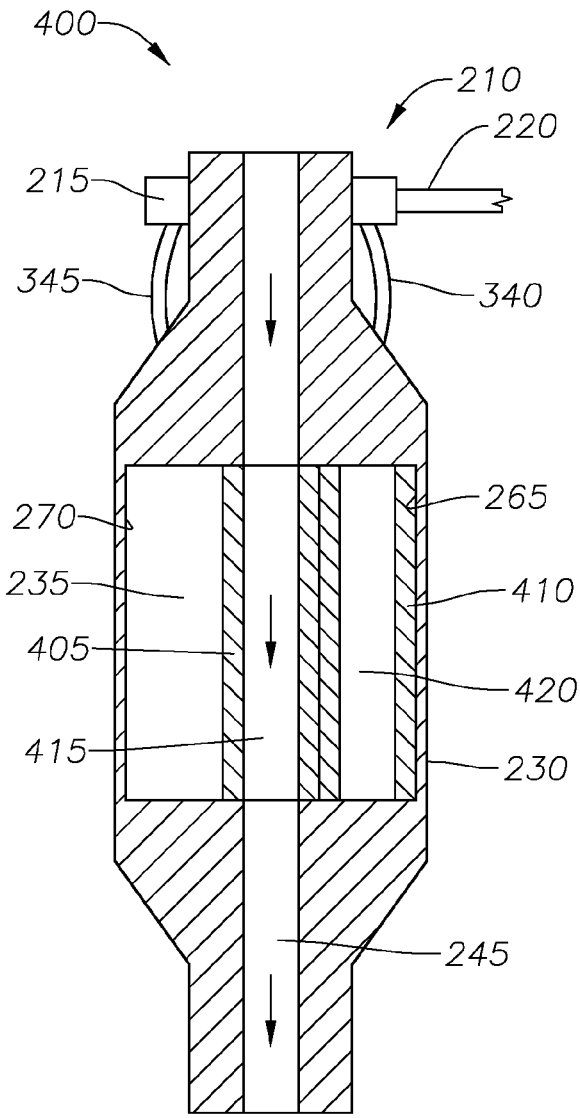
FIG. 11 schematically depicts the cementing manifold of FIG. 10 after actuation.

FIG. 11 depicts the tube 405 after actuation. As seen in this figure, the throughbore 415 of the tube 405 is aligned with the flowbore 245 of the enclosure 230. A dart, which was previously stored in tube 405, has been released from the tube 405 and carried from the cementing manifold 400 by cement flow through the flowbore 245.

After a dart has been released from the tube 405 in the manner described above, the actuation system 210 may receive another signal directing the system 210 to actuate the tube 410 to release a dart stored therein. In response, the actuation system 210 permits a burst of pressurized air to flow from the air flow line 220, through the air swivel 215 and the distribution line 340, and into chamber 235. Upon entering the chamber 235, the pressurized air actuates the tube 410 by applying a pressure load to the outer surface of the tube 410, causing both tubes 405, 410 to translate along the base 275 until the tube 405 contacts the enclosure side 270. When the tube 405 contacts the side 270, the tubes 405, 410 cease to translate along the base 275 and the throughbore 420 of the tube 410, which contains a dart, is aligned with the enclosure flowbore 245. Thus, the actuation system 210, in response to two remote signals, actuates the tubes 405, 410 to release two darts into a cementing operation.

Thus, the cementing manifolds 200, 400 share common features believed advantageous. In particular, the manifolds 200, 400 are preferably loaded and reloaded as needed at the well site. Additionally, actuation of the cementing manifolds 200, 400 is accomplished by remote activation without the need to position rig personnel in vicinity of the manifolds 200, 400 and without the need to slow or interrupt rotation of the drill string. Moreover, actuation of the cementing manifolds 200, 400 as well as the release of a dart(s) or sphere from the manifolds 200, 400 into the drill string are remotely verified without the need to position rig personnel in the vicinity of the cementing manifold and without the need to slow or interrupt rotation of the drill string.

While preferred embodiments have been shown and described, modifications thereof can be made by one skilled in the art without departing from the scope or teachings herein. The embodiments described herein are exemplary only and are not limiting. Many variations and modifications of the system and apparatus are possible and are within the scope of the invention. For instance, the actuation system may use another type of gas, in place of air, to actuate the dart cartridge and/or ball container. Furthermore, the actuation system may actuate the dart cartridge and/or ball container using an electrical, hydraulic, or other means. Additionally, the dart cartridge and ball container may be configured to store and release more than two darts and one sphere, respectively. Accordingly, the scope of protection is not limited to the embodiments described herein, but is only limited by the claims that follow, the scope of which shall include all equivalents of the subject matter of the claims.

What is claimed is:

1. A manifold for providing fluid and projectiles to downhole tubulars, the manifold comprising:

a housing having a fluid entry port and a fluid exit port;

a cartridge in said housing, said cartridge comprising a first throughbore containing a projectile and a second throughbore, said cartridge being radially translatable in a linear motion between a first and a second position;

wherein, in said first position, said first throughbore is out of fluid communication with said entry port and said exit port and said second throughbore is in fluid communication with said entry port and said exit port;

wherein, in said second position, said first throughbore is in fluid communication with said entry port and said exit port and said second throughbore is out of fluid communication with said entry port and said exit port;

a translatable container having a throughbore that houses a second projectile, said translatable container axially spaced from said cartridge and translatable into said fluid passageway to align said throughbore of said translatable container with said fluid passageway; and an actuator to radially translate said cartridge in a linear motion between said first and second positions.

2. The manifold of claim 1, wherein said cartridge is configured to store said projectile when in said first position.

3. The manifold of claim 2, further comprising a fluid flowing into said housing through said fluid entry port and flowing out of said housing through said fluid exit port.

4. The manifold of claim 1, wherein said cartridge is configured to release said projectile when in said second position.

5. The manifold of claim 1, wherein said projectile is a dart.

6. The manifold of claim 1, wherein said projectile is a sphere.

7. The manifold of claim 1, wherein said actuator is further configured to transmit a signal when said actuator translates said cartridge.

8. The manifold of claim 1, wherein said actuator is further configured to transmit a signal when said projectile leaves the manifold through said fluid exit port.

9. The manifold of claim 1, wherein the manifold is less than 13 feet in length.

10. The manifold of claim 1, wherein said cartridge further comprises a third throughbore to contain a second projectile disposed laterally from said first projectile, and said actuator is configured to radially translate said cartridge in a linear motion to a third position to radially displace said second projectile.

11. A method for providing fluid and projectiles to downhole tubulars, comprising:

providing a manifold having a through-passage in fluid communication with a tubing string, said tubing string comprising said tubulars;

providing a cartridge disposed in said manifold;

providing a translatable container housing having a throughbore in said manifold;

storing a projectile in said cartridge and isolated from said through-passage;

storing a second projectile in said translatable container housing, wherein the second projectile is axially spaced from said cartridge, and said translatable container housing is translatable into said fluid passageway to align said throughbore of said translatable container with said fluid passageway;

conveying said fluid through said through-passage and said cartridge while said projectile is isolated;

radially translating said cartridge in a linear motion in said manifold to bring said projectile into said through-passage; and expelling said projectile from said through-passage into the tubing string using said fluid.

12. The method of claim 11, further comprising rotating said tubing string while translating said cartridge.

13. The method of claim 11, further comprising:

rotating said tubing string at a first speed while said projectile is isolated from said through-passage; and rotating said tubing string at the first speed while translating said cartridge to bring said projectile into said through-passage.

14. The method of claim 11, further comprising transmitting a signal when said cartridge is translated.

15. The method of claim 11, further comprising transmitting a signal when said projectile is expelled from said through-passage into the tubing string.

16. The method of claim 11, further comprising:

inserting said projectile into said cartridge at the well site; and loading said cartridge into said manifold at the well site.

17. The method of claim 16, further comprising performing said loading and said inserting to field certify said manifold.

18. An apparatus for providing fluid and projectiles to tubulars in a borehole, comprising:

a fluid supply;

a tubular member;

a manifold coupled to said fluid supply and said tubular member, said manifold comprising:

a fluid passageway therethrough; and a plurality of projectiles stored therein, wherein said projectiles are stored laterally relative to each other in said manifold;

a cartridge housing one or more of said projectiles and radially translatable in a linear motion; and a translatable container having a throughbore that houses a second projectile, said translatable container axially spaced from said cartridge and translatable into said fluid passageway to align said throughbore of said translatable container with said fluid passageway; and an actuator configured to radially translate said stored projectiles and the second projectile in a linear motion into said fluid passageway.

19. The apparatus of claim 18, wherein said fluid supply comprises cement.

20. The apparatus of claim 18, wherein said actuator is one or more of the group comprising of an electric actuator, a hydraulic actuator, and a pneumatic actuator.

21. The apparatus of claim 20, wherein said actuator is pneumatic, further comprising:

a pressurized air supply; and one or more flowlines;

wherein said pressurized air supply is distributed by the one or more flowlines to translate said projectile into said fluid passageway.

22. The apparatus of claim 18, wherein said actuator is remotely actuated.

23. The apparatus of claim 18, wherein said actuator is configured to transmit a signal when said projectile translates.

24. The apparatus of claim 18, wherein said actuator is configured to transmit a signal when said projectile exits said manifold.

25. The apparatus of claim 18, wherein said container comprises:

a first position wherein said container is not in fluid communication with said entry port and said exit port; and a second position wherein said container is in fluid communication with said entry port and said exit port.

26. A method for providing fluid and projectiles to downhole tubulars, comprising:

providing a manifold having a through-passage in fluid communication with a tubing string, said tubing string comprising said tubulars;

disposing at least one cartridge in said manifold;

disposing at least one translatable container housing having a throughbore axially spaced from said cartridge in said manifold;

isolating from said through-passage a plurality of laterally stored projectiles in said at least one cartridge;

isolating from said through-passage a second projectile in said translatable container housing, wherein the second projectile is axially spaced from said stored projectiles and said translatable container housing translatable into said fluid passageway to align said throughbore of said translatable container with said fluid passageway;

conveying said fluid through said through-passage and said at least one cartridge while said projectiles are isolated;

selectively radially translating said at least one cartridge in a linear motion in said manifold to move one of said projectiles into said through-passage;

expelling said projectile from said through-passage into the tubing string using said fluid.

27. The method of claim 26, further comprising radially displacing any one of said projectiles from a fully stored position to said through-passage.

28. The method of claim 27, wherein said radial displacement for each of said projectiles is in a different direction relative to each of the other projectiles.

* * * * *